US009049970B2

(12) United States Patent
Dorra

(10) Patent No.: US 9,049,970 B2
(45) Date of Patent: Jun. 9, 2015

(54) AUTO CLEANING TOILET SEAT WITH ANAL CLEANING DEVICE AND BLOW DRY

(76) Inventor: Maximo Dorra, Sunny Isles Beach, FL (US)

( * ) Notice: Subject to any disclaimer, the term of this patent is extended or adjusted under 35 U.S.C. 154(b) by 0 days.

(21) Appl. No.: 14/007,893

(22) PCT Filed: Jun. 13, 2012

(86) PCT No.: PCT/US2012/042269

§ 371 (c)(1),
(2), (4) Date: Sep. 26, 2013

(87) PCT Pub. No.: WO2013/052179

PCT Pub. Date: Apr. 11, 2013

(65) Prior Publication Data

US 2014/0047626 A1 Feb. 20, 2014

Related U.S. Application Data

(63) Continuation of application No. 13/253,197, filed on Oct. 5, 2011, now Pat. No. 8,365,317, which is a continuation-in-part of application No. 12/823,873, filed on Jun. 25, 2010, now Pat. No. 8,060,953.

(51) Int. Cl.

| | |
|---|---|
| ***A47K 13/00*** | (2006.01) |
| ***E03D 9/02*** | (2006.01) |
| ***A47K 13/30*** | (2006.01) |
| ***E03D 9/00*** | (2006.01) |
| ***E03D 9/08*** | (2006.01) |

(52) U.S. Cl.
CPC ..... *A47K 13/302* (2013.01); *E03D 9/002* (2013.01); *E03D 9/08* (2013.01)

(58) Field of Classification Search
CPC ..... A47K 13/302
USPC ..... 4/233, 223
See application file for complete search history.

(56) References Cited

U.S. PATENT DOCUMENTS

| | | | | |
|---|---|---|---|---|
| 2,605,478 | A * | 8/1952 | Lassiter | 4/662 |
| 3,247,524 | A | 4/1966 | Umann | |
| 3,919,726 | A * | 11/1975 | Godwin et al. | 4/312 |
| 4,558,473 | A | 12/1985 | Morikawa et al. | |
| 4,628,548 | A | 12/1986 | Kurosawa et al. | |
| 4,785,482 | A * | 11/1988 | Nelva-Pasqual et al. | 4/233 |
| 4,903,347 | A | 2/1990 | Garcia et al. | |
| 4,998,300 | A | 3/1991 | Sharifzadeh | |
| 5,022,098 | A | 6/1991 | Brower | |
| 5,123,124 | A * | 6/1992 | Brower | 4/234 |

(Continued)

FOREIGN PATENT DOCUMENTS

JP 2000-160631 A 6/2000

*Primary Examiner* — Huyen Le
*Assistant Examiner* — Christine Skubinna
(74) *Attorney, Agent, or Firm* — The Concept Law Group, P.A.; Scott D. Smiley; Mark C. Johnson

(57) ABSTRACT

A toilet seat cover assembly that has a cover shaped to fit over a toilet seat, the cover including internal side walls and an arm assembly disposed within the cover, the arm assembly including at least one arm that radially spans from an axis of rotation, defines a path of rotation, has a proximal end and a distal end, the distal end defining a discontinuity between the distal end and the internal side walls such that it is operable to move freely of the internal side walls, and defines a first plurality of cutouts fluidly coupled to a liquid source and sized to discharge liquid matter over the toilet seat.

19 Claims, 12 Drawing Sheets

(56) References Cited

U.S. PATENT DOCUMENTS

| | | | | |
|---|---|---|---|---|
| 5,319,811 | A | 6/1994 | Hauri | |
| 5,359,736 | A | 11/1994 | Olivier | |
| 6,105,178 | A | 8/2000 | Kurisaki et al. | |
| 6,769,140 | B1 | 8/2004 | Olivier | |
| 7,096,518 | B2 | 8/2006 | Takenaga | |
| 7,155,755 | B2 | 1/2007 | Olivier | |
| 7,191,473 | B2 | 3/2007 | Matsumoto et al. | |
| 7,216,374 | B2 | 5/2007 | Hassan | |
| 2003/0074731 | A1* | 4/2003 | Sumino | 4/667 |
| 2005/0028263 | A1 | 2/2005 | Wodeslavsky | |
| 2005/0246828 | A1 | 11/2005 | Shirai et al. | |
| 2006/0021121 | A1 | 2/2006 | Moussa | |
| 2006/0064810 | A1 | 3/2006 | Teraniski et al. | |
| 2010/0257662 | A1* | 10/2010 | Huang | 4/223 |

* cited by examiner

TIME CHARTS
Cover assembly 280 Fig. 13A
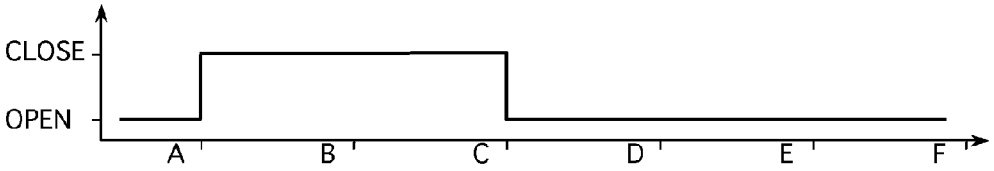
Water and Disinfectant to liquid matter duct assembly 360 Fig. 13B
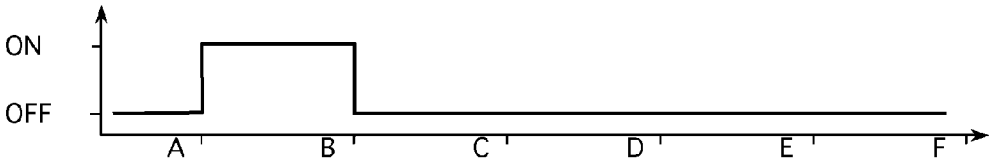
Air from air turbines 100 and 200 to air duct assembly 340 Fig. 13C
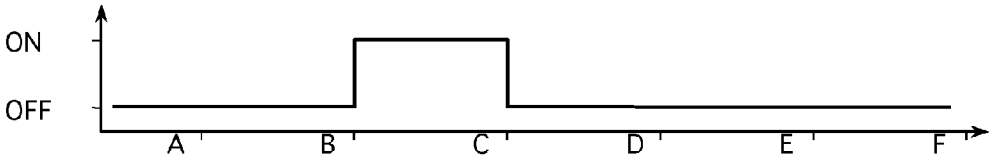
Water from impeller pump 98 to bidet 122 Fig. 13D
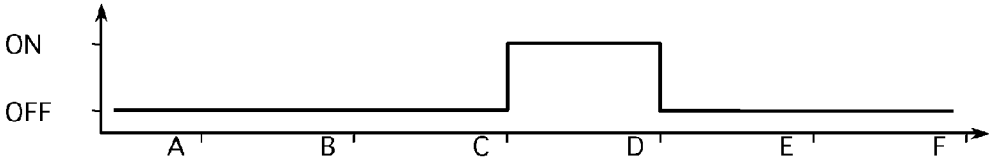
Air from air turbines 100 and 200 to flaps 248 Fig. 13E
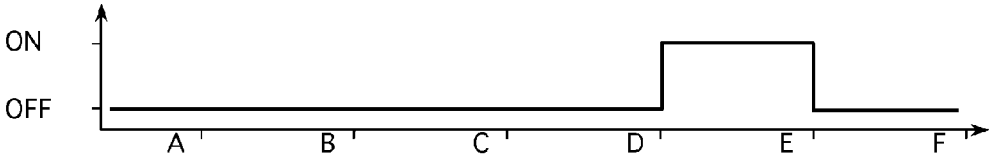

TIME CHARTS
Cover assembly 280 Fig. 14A
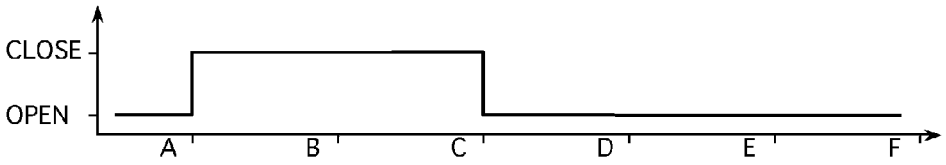
Water and Disinfectant to liquid matter duct assembly 360 Fig. 14B
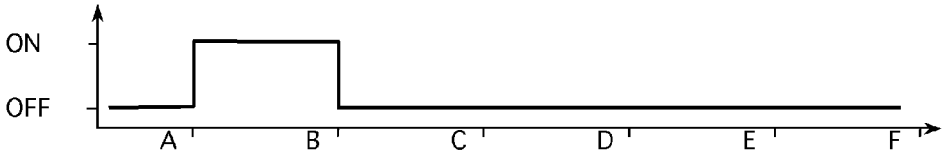
Air from air turbines 100 and 200 to air duct assembly 340 Fig. 14C
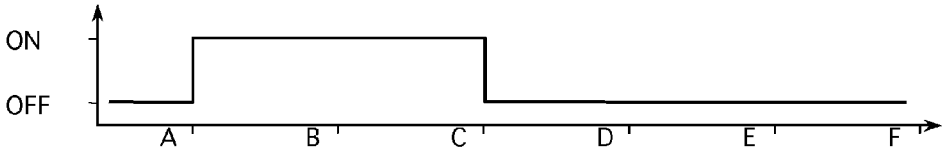
Water from impeller pump 98 to bidet 122 Fig. 14D
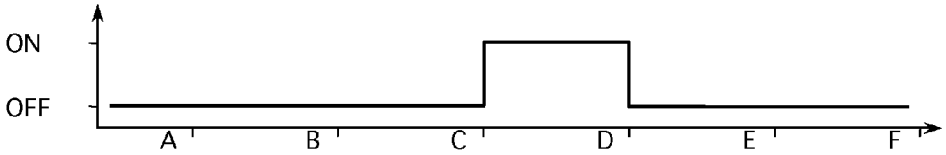
Air from air turbines 100 and 200 to flaps 248 Fig. 14E
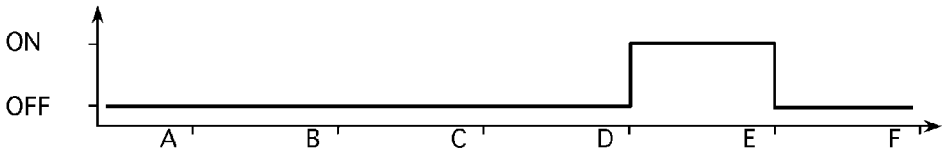

AUTO CLEANING TOILET SEAT WITH ANAL CLEANING DEVICE AND BLOW DRY

CROSS-REFERENCE TO RELATED APPLICATION

This application claims priority to PCT Application No. PCT/US12/42269 filed Jun. 13, 2012, which claims priority to U.S. application Ser. No. 13/253,197, filed on Oct. 5, 2011, now issued as U.S. Pat. No. 8,365,317, which is a continuation-in-part of U.S. application Ser. No. 12/823,873, filed on Jun. 25, 2010, now issued as U.S. Pat. No. 8,060,953; the entirely of these applications is incorporated by reference.

FIELD OF THE INVENTION

The present invention relates to toilet systems, and more particularly, to an automatic toilet seat cleaning system that also serves to hygienically cleanses and dries a user of such system.

BACKGROUND OF THE INVENTION

Applicant believes that one of the closest references corresponds to U.S. Patent Application Publication No. 2006/0064810, published on Mar. 30, 2006, to Teranishi et al. for a human private part washing apparatus.

Applicant believes that another reference corresponds to U.S. Patent Application Publication No. 2005/0246828, published on Nov. 10, 2005, to Shirai et al. for a hygiene washing apparatus.

Applicant believes that another reference corresponds to U.S. Patent Application Publication No. 2005/0028263, published on Feb. 10, 2005, to Wodeslaysky for a water and space conservation toilet/bidet combination.

Applicant believes that another reference corresponds to U.S. Pat. No. 7,216,374 issued to Hassan on May 15, 2007, for a smart toilet seat.

Applicant believes that another reference corresponds to U.S. Pat. No. 7,191,473 issued to Matsumoto et al. on Mar. 20, 2007, for a sanitary washing apparatus.

Applicant believes that another reference corresponds to U.S. Pat. No. 7,155,755 issued to Olivier on Jan. 2, 2007, for a toilet seat having a cleansing facility.

Applicant believes that another reference corresponds to U.S. Pat. No. 7,096,518 issued to Takenaga on Aug. 29, 2006, for a body part cleansing unit for toilet.

Applicant believes that another reference corresponds to U.S. Pat. No. 6,769,140 issued to Olivier on Aug. 3, 2004, for a toilet seat having a cleansing facility.

Applicant believes that another reference corresponds to U.S. Pat. No. 6,105,178 issued to Kurisaki et al. on Aug. 22, 2000, for a sanitary cleansing apparatus.

Applicant believes that another reference corresponds to U.S. Pat. No. 5,359,736 issued to Olivier on Nov. 1, 1994, for a spray means for a toilet pedestal.

Applicant believes that another reference corresponds to U.S. Pat. No. 5,319,811 issued to Haurion on Jun. 14, 1994, for a closet seat for a water closet as well as an apparatus for cleaning the posterior on a water closet having a seat.

Applicant believes that another reference corresponds to U.S. Pat. No. 4,628,548 issued to Kurosawa et al. on Dec. 16, 1986, for a device and method of moving and controlling the position of a slidable body such as used for body cleansing.

Applicant believes that another reference corresponds to U.S. Pat. No. 4,558,473 issued to Morikawa et al. on Dec. 17, 1985, for sanitary cleaning equipment.

Applicant believes that another reference corresponds to U.S. Pat. No. 3,247,524 issued to Umann on Apr. 26, 1966, for a hygienic apparatus for use on toilet bowls.

Other patents describing the closest subject matter provide for a number of more or less complicated features that fail to solve the problem in an efficient and economical way. None of these patents suggest the novel features of the present invention.

SUMMARY OF THE INVENTION

The instant invention is a combined automatic toilet self-cleaning and user hygienic system, having a housing assembly, an electrical system, a liquid matter system, a turbine assembly, and a manifold assembly. The manifold assembly has a first at least one cut out. The manifold assembly is partially housed within a manifold. The manifold assembly has ducting for air to flow originating from the turbine assembly. The manifold assembly further has a bidet for liquid matter to exit from the liquid matter system directed onto a user positioned on a toilet seat assembly. A toilet seat assembly has mounting brackets to mount onto the manifold assembly for rotary movement of the seat assembly. A cover assembly has a mounting frame to mount onto the manifold assembly. The cover assembly further has a rotating arm assembly.

It is therefore one of the main objects of the present invention to provide an auto cleaning toilet seat with anal cleaning device and blow dry that disinfects the toilet seat before use.

It is another object of this invention to provide an apparatus that washes and dries the anus and adjacent body opening areas of a user after using a toilet.

It is another object of this invention to provide an automatic toilet seat cleaning system, which embodiments can be used in circular and/or oval shape toilet bowls.

It is another object of this invention to provide an auto cleaning toilet seat with anal cleaning device and blow dry that is volumetrically efficient.

It is another object of this invention to provide an auto cleaning toilet seat with anal cleaning device and blow dry which is of a durable and reliable construction, inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

30

FIGS. 13A, 13B, 13C, 13D, and 13E are preferred timing charts of the instant invention.

FIGS. 14A, 14B, 14C, 14D, and 14E are alternate timing charts of the instant invention.

DETAILED DESCRIPTION OF THE PREFERRED EMBODIMENT

Figure 1:
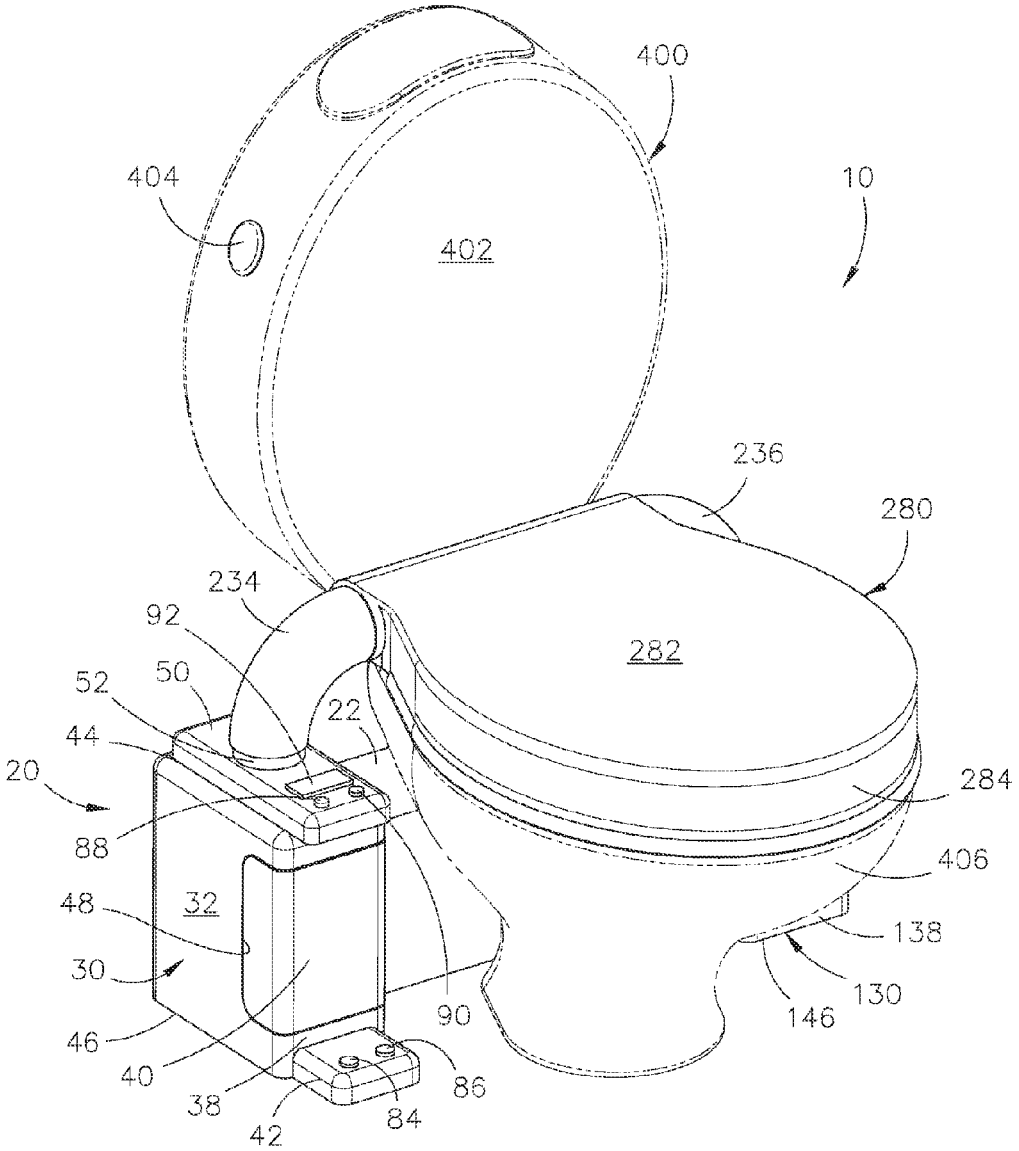
FIG. 1 is an isometric view of the preferred embodiment for the instant invention with its cover assembly in a closed position and installed onto a standard toilet.

It is evident that an invention such as the automatic toilet seat-cleaning system claimed in the present application is quite desirable because it disinfects the toilet seat before use. The claimed invention is also quite desirable because it provides an apparatus that washes and dries the anus and adjacent body opening areas of a user after using a toilet. In addition, the claimed invention can be used in circular and/or oval shape toilet bowls. Furthermore, the claimed invention is volumetrically efficient, of a durable and reliable construction, and it is inexpensive to manufacture and maintain while retaining its effectiveness.

Referring now to the drawings, the present invention is a combined automatic toilet self-cleaning and user hygienic system and is generally referred to with numeral 10. It can be observed that it basically includes housing assembly 20, electrical system 80, liquid matter system 110, turbine assemblies 100 and 200, manifold assembly 220, manifold 240, toilet seat assembly 270, and cover assembly 280.

As seen in FIG. 1, instant invention 10 is mounted to toilet 400, which comprises tank 402 with flush button 404, and toilet bowl 406. Housing assembly 20 comprises bridge 22 connecting tower assemblies 30 and 130 cooperatively mounted at lateral sides of toilet 400. Bridge 22 is preferably positioned behind a base of toilet bowl 406.

Figure 2:
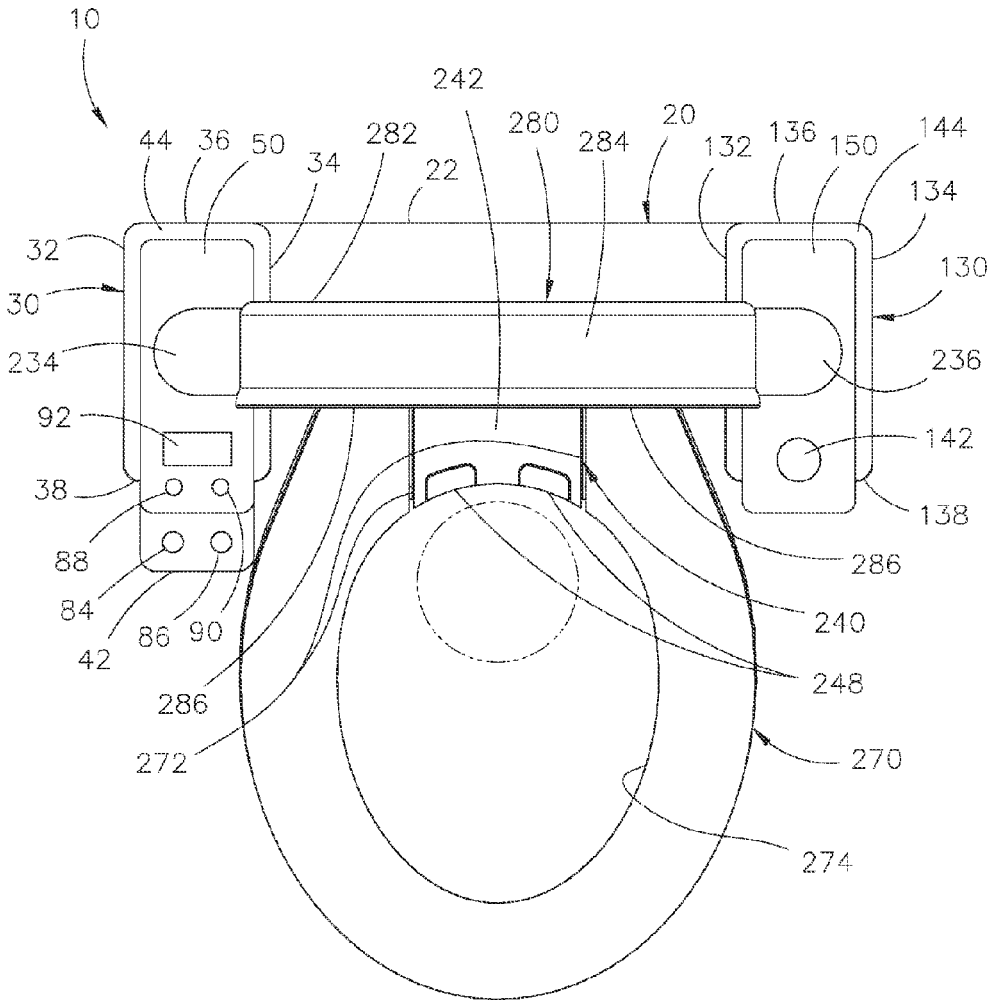
FIG. 2 is a top plan view of the instant invention with its cover assembly in an open position and installed onto the standard toilet, whereby the tank of the toilet has been removed for illustrative purposes.

As best seen in FIG. 2, tower assembly 30 comprises lateral walls 32 and 34, rear wall 36, front wall 38, base switch housing 42, top wall 44, base 46 as seen in FIG. 1, and top switch housing 50 mounted onto top wall 44. Similarly, tower assembly 130 comprises lateral walls 132 and 134, rear wall 136, front wall 138, pressure regulator 142, top wall 144, base 146 as seen in FIG. 1, and top regulator housing 150 mounted onto top wall 144.

Figure 3:
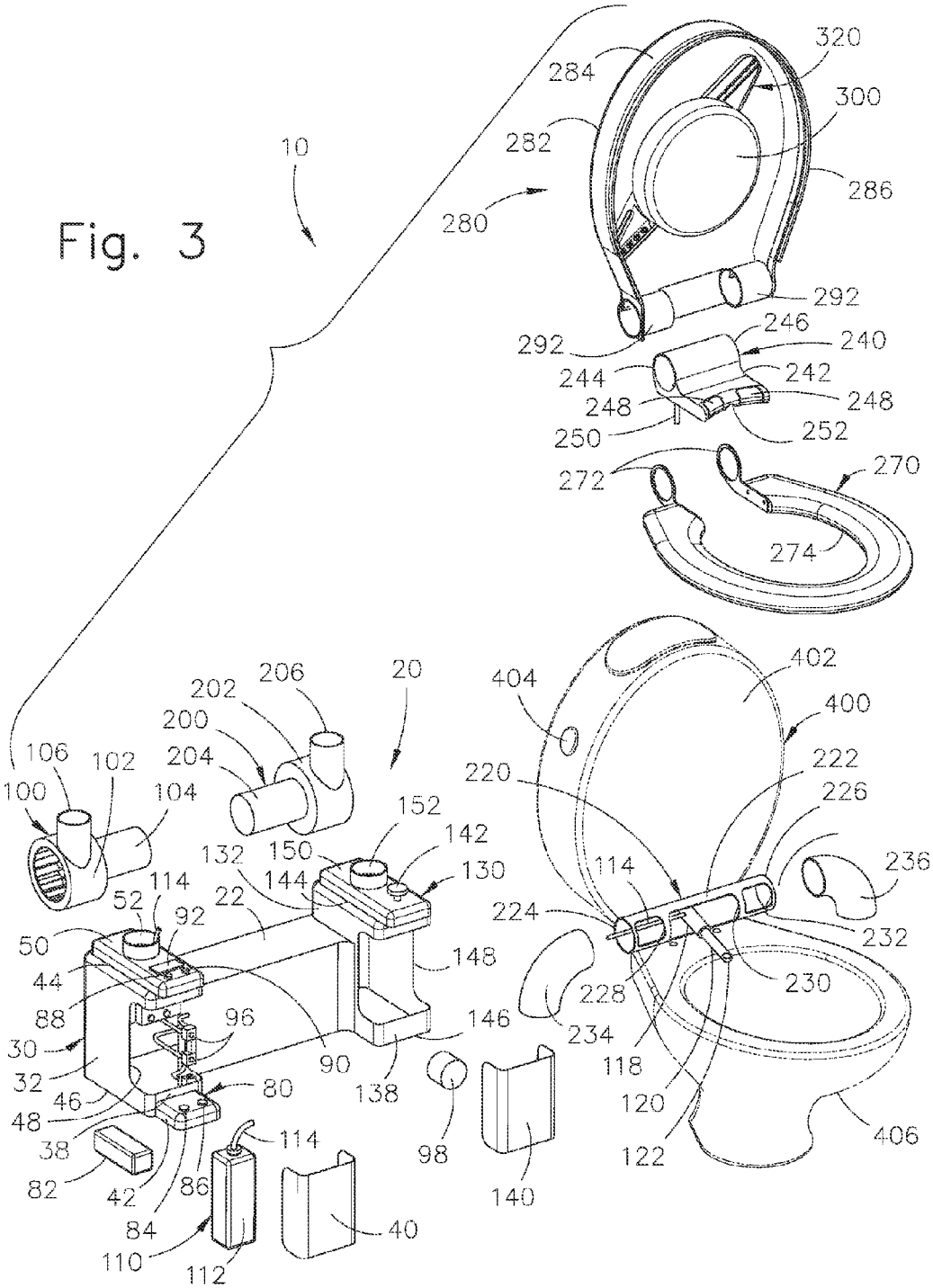
FIG. 3 is an exploded view of the instant invention.

As seen in FIG. 3, front wall 38 of tower assembly 30 has front cover panel 40 removably mounted to cutout 48. Conduit 52 extends upwardly from top switch housing 50. Front wall 138 of tower assembly 130 has front cover panel 140 removably mounted to cutout 148. Conduit 152 extends upwardly from top regulator housing 150.

Electrical system 80 comprises control box 82 with switches 84 and 86 disposed at base switch housing 42, and switches 88 and 90 disposed at top switch housing 50. In a preferred embodiment, screen 92 is positioned at top switch housing 50 and functions to give a status of instant invention 10. Electrical system 80 further comprises electrical wiring 94, seen in FIG. 12, electrical valves 96 and impeller pump 98. Pressure regulator 142 is connected to impeller pump 98.

Pressure regulator 142 functions to regulate liquid matter LM pressure exiting bidet base 118 having telescopic section 120, and specifically bidet 122. Such liquid matter LM may be, but is not limited to, water, water combined with other matter such as a chemical, a chemical solution, and/or a chemical solution comprising a disinfectant as an example. The chemical, chemical solution, and/or chemical solution comprising a disinfectant may be of gas, liquid, semi-liquid, semi-solid, or solid matter.

Turbine assembly 100 is housed within tower assembly 30 and comprises housing 102, motor housing 104 and outlet 106. Outlet 106 connects to conduct 52. Similarly, turbine assembly 200 is housed within tower assembly 130 and comprises housing 202, motor housing 204 and outlet 206 that connects to conduit 152.

Figure 12:
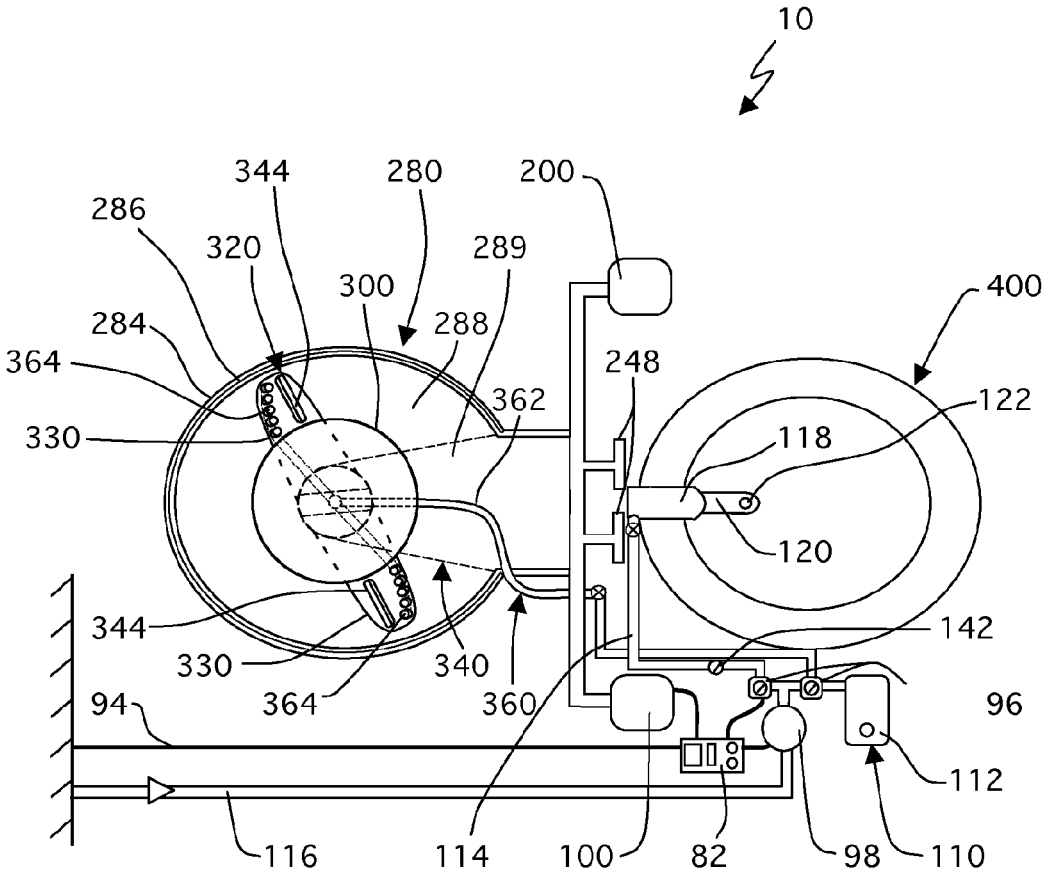
FIG. 12 is a schematic diagram of the instant invention.

Liquid matter system 110 includes disinfectant container 112 housed within tower assembly 30, connecting tube 114, and bidet base 118 having telescopic section 120 and bidet 122 at its distal end. Liquid matter system 110 further includes line 116 from a water source, which is best seen in FIG. 12.

As also seen in FIG. 3, manifold assembly 220 has wall 222 with ends 224 and 226, cutouts 228 and 232, and central cutout 230. Manifold assembly 220 further comprises air ducts 234 and 236 that mount to conduits 52 and 152 of top switch housing 50 and top regulator housing 150 respectively. Connecting tube 114 goes through manifold assembly 220. Bidet base 118 with telescopic section 120 is partially housed within manifold assembly 220 and protrudes through central cutout 230.

Manifold 240 is mounted with mounting posts 250 passing through standard openings in toilet bowl 406 used for mounting of traditional toilet seats. Manifold 240 comprises housing 242 with ends 244 and 246. Manifold flaps 248 are cooperatively disposed at a forward section of manifold 240. Manifold flaps 248 have spring-loaded hinges, not seen. Tubular cutout 252 is also at the forward section of manifold 240 between manifold flaps 248.

Toilet seat assembly 270 has mounting brackets 272 and inner edge 274.

Mounting brackets 272 mount to ends 244 and 246 of manifold 240. Mounting frame 292 mounts to mounting brackets 272. It is noted that manifold assembly 220 passes through manifold 240, mounting brackets 272, and mounting frame 292. Proximal ends of air ducts 234 and 236 are mounted to mounting frame 292, which in turn are next to ends 224 and 226 of manifold assembly 220. Bidet base 118 is positioned through central cutout 230 of manifold assembly 220, and through an opening of manifold 240, not shown, to be cooperatively disposed at tubular cutout 252.

It is noted that manifold assembly 220, manifold 240, mounting brackets 272, and mounting frame 292 are on a same axis.

As also seen in FIG. 3, manifold assembly 220 has wall 222 with ends 224 and 226, cutouts 228 and 232, and central cutout 230. Manifold assembly 220 further comprises air ducts 234 and 236 that mount to conduits 52 and 152 of top switch housing 50 and top regulator housing 150 respectively. Connecting tube 114 goes through manifold assembly 220. Bidet base 118 with telescopic section 120 is partially housed within manifold assembly 220 and protrudes through central cutout 230.

Manifold 240 is mounted with mounting posts 250 passing through standard openings in toilet bowl 406 used for mounting of traditional toilet seats. Manifold 240 comprises housing 242 with ends 244 and 246. Manifold flaps 248 are cooperatively disposed at a forward section of manifold 240. Manifold flaps 248 have spring-loaded hinges, not seen. Tubular cutout 252 is also at the forward section of manifold 240 between manifold flaps 248.

Toilet seat assembly 270 has mounting brackets 272 and inner edge 274.

Mounting brackets 272 mount to ends 244 and 246 of manifold 240. Mounting frame 292 mounts to mounting brackets 272. It is noted that manifold assembly 220 passes through manifold 240, mounting brackets 272, and mounting frame 292. Proximal ends of air ducts 234 and 236 are mounted to mounting frame 292, which in turn are next to ends 224 and 226 of manifold assembly 220. Bidet base 118 is positioned through central cutout 230 of manifold assembly 220, and through an opening of manifold 240, not shown, to be cooperatively disposed at tubular cutout 252.

Figure 4:
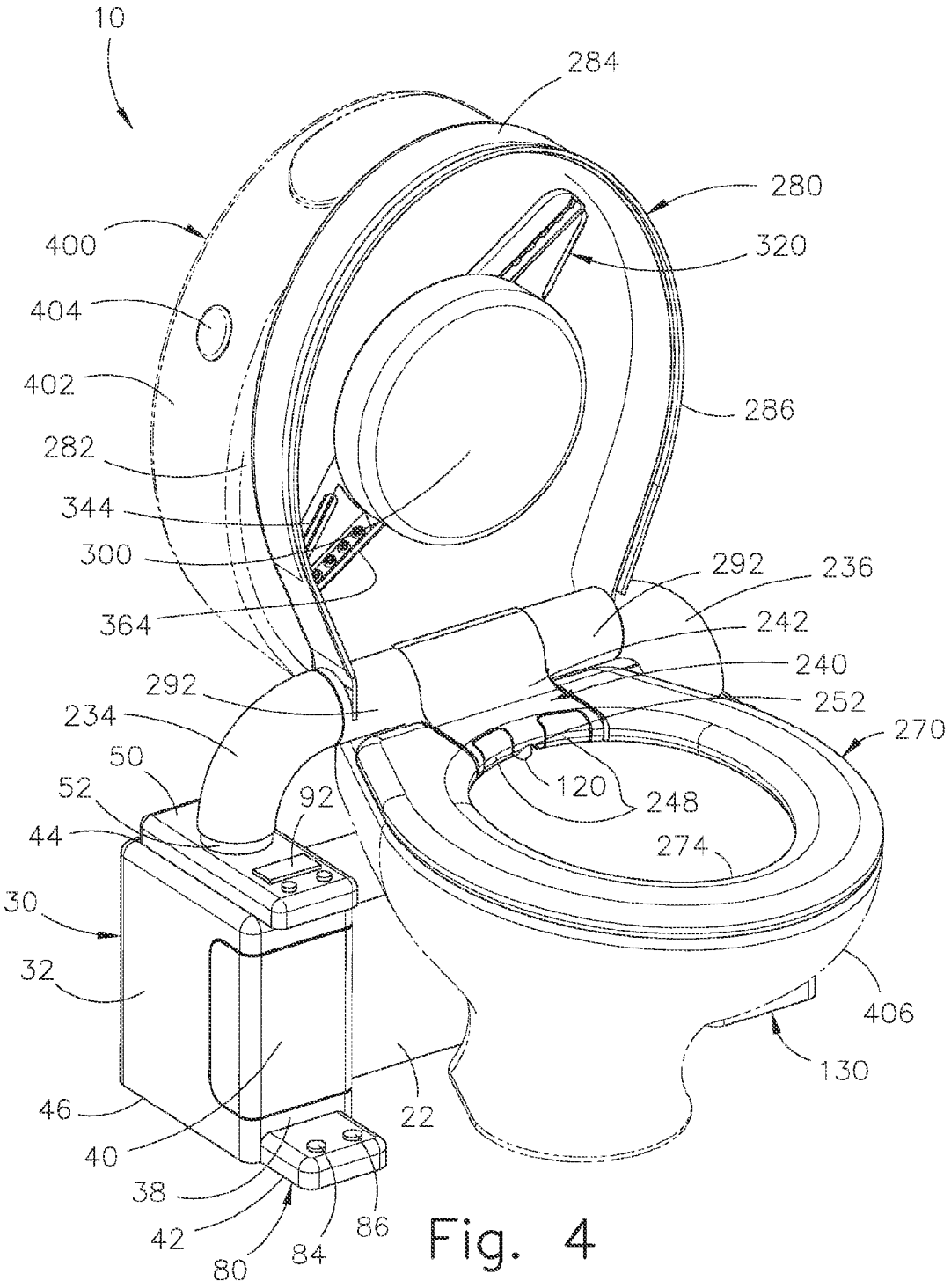
FIG. 4 is an isometric view of the preferred embodiment for the instant invention with its cover assembly in an open position and installed onto the standard toilet having a circular toilet bowl.
Figure 5:
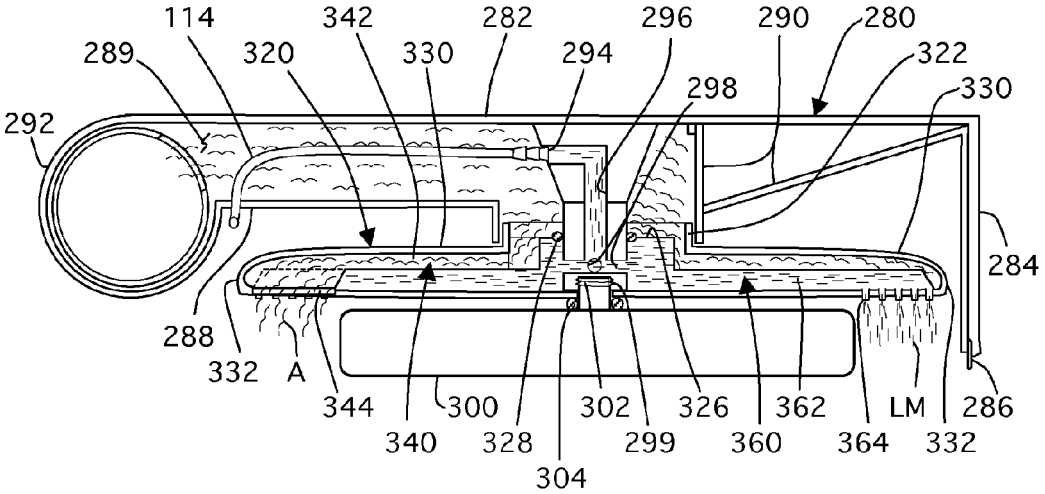
FIG. 5 is a schematic cross section of the cover assembly, showing the liquid matter and air flowing.
Figure 6:
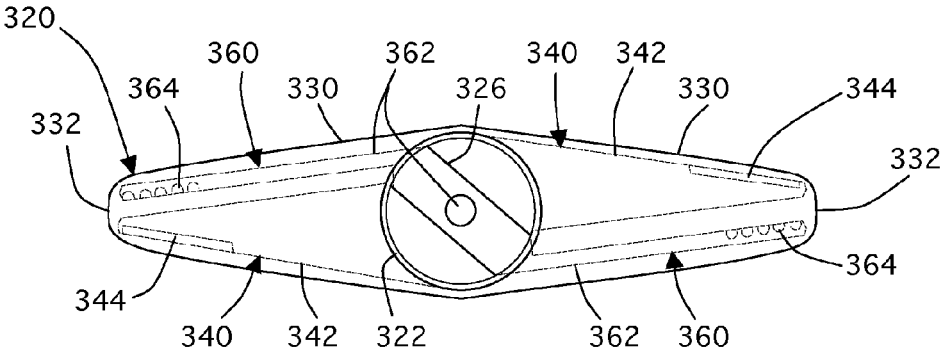
FIG. 6 is a top view of a rotating arm assembly.
Figure 7:
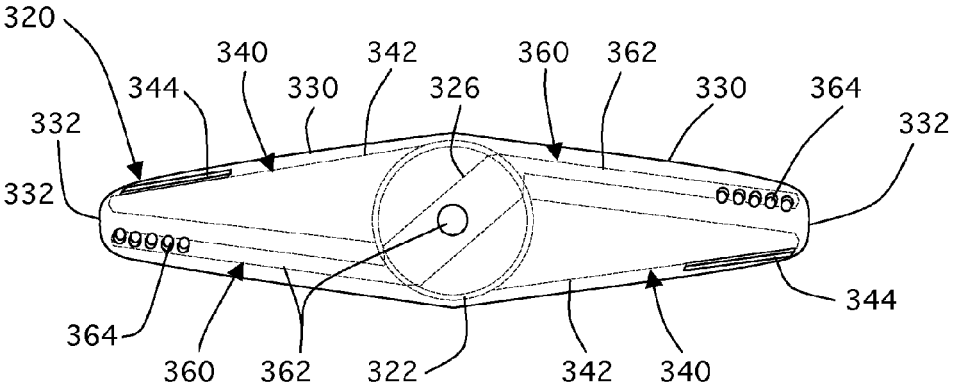
FIG. 7 is a bottom view of the rotating arm assembly.

It is noted that manifold assembly 220, manifold 240, mounting brackets 272, and mounting frame 292 are on a same axis. As seen in FIGS. 4 and 5, cover assembly 280 comprises exterior wall 282, best seen in FIG. 1, sidewall 284 with edge 286, interior wall 288, structural wall 290, and mounting frame 292. Sidewall 284 fits around toilet seat assembly 270 to force liquid matter to flow into toilet bowl 406. As best seen in FIG. 5, cover assembly 280 also has entry port 294 to connecting tube 114 as an access for liquid matter LM from liquid matter system 110. Entry port 294 extends to channel 296 having holes 298 extending perpendicularly therefrom and hole 299. Alignment assembly 300, having threaded neck 302, secures into hole 299. Spacer 304 keeps rotating arm assembly 320 in place and spaced apart from alignment assembly 300. Spacer 304 is made out of a self-lubricated material, preferably, to facilitate the free movement of rotating arm assembly 320. In an alternate embodiment, neck 302 is not threaded and is forced into hole 298. When cover assembly is in the closed position, alignment assembly 300 aligns interiorly to inner edge 274 of toilet seat assembly 270 leaving a space for liquid matter LM to go through. As seen in FIGS. 5, 6, and 7, cover assembly 280 has mounting frame 292 to mount onto manifold assembly 220. Cover assembly 280 further comprises rotating arm assembly 320. Rotating arm assembly 320 has at least one cutout 344 for air A to flow originating from turbine assemblies 100 and 200. Rotating arm assembly 320 further has at least one cutout 364 for liquid matter LM to exit therefrom that is directed onto toilet seat assembly 270 in a manner so as to provide cleaning of toilet seat assembly 270. As best seen in FIGS. 5 and 6, a section of exterior wall 282 and structural walls 290 define channel 289.

More specifically, rotating arm assembly 320 further has hub 322. Hub 322 fits into interior walls of cover assembly 280, and specifically interior wall 288 and structural walls 290. Rotating arm assembly 320 also has bridge 326 within hub 322 and o-ring 328, or a similar type of sealing member. Bridge 326 connects to liquid matter duct assembly 360. Extending from hub 322 is at least one arm 330 having end 332. In a preferred embodiment, hub 322 has arms 330 extending in opposite directions therefrom. Each arm 330 comprises air duct assembly 340 and liquid matter duct assembly 360. Air duct assembly 340 has air ducts 342 comprising at least one cutout 344 for air A to flow originating from turbine assemblies 100 and 200. Liquid matter duct assembly 360 has liquid matter ducts 362 comprising at least one cutout 364 for liquid matter LM to exit therefrom. The at least one cutout 344 is shaped to propel the rotating arm assembly 320 around an axis of rotation solely by an emission of air from the at least one cutout 344. In a similar fashion, the at least one cutout 364 is shaped to propel the arm assembly around the axis of rotation solely by an emission of liquid matter LM from the at least one cutout 364. As previously stated above, the liquid matter LM is accessed from the liquid matter system 110. The liquid matter system 110 is fluidly coupled to the cutouts 364, such that liquid matter LM comes from the liquid matter system 110, without fluid introduction from the tank 402 of the toilet 400.

Figure 8A:
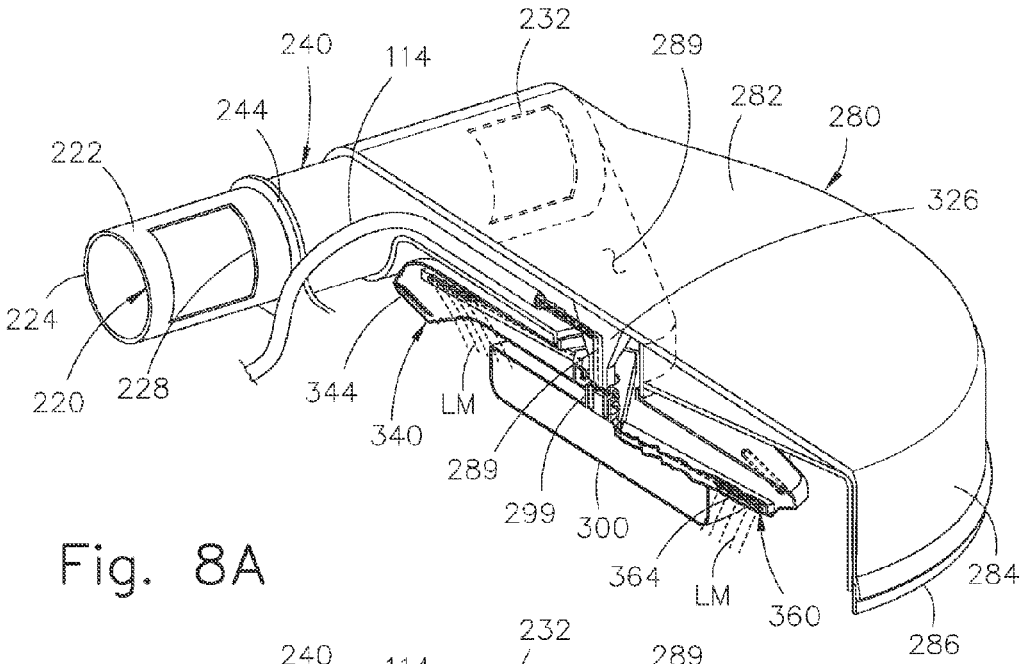
FIG. 8A is a partially sectioned isometric view of the cover assembly in the closed position and showing an activated liquid matter duct assembly.
Figure 8B:
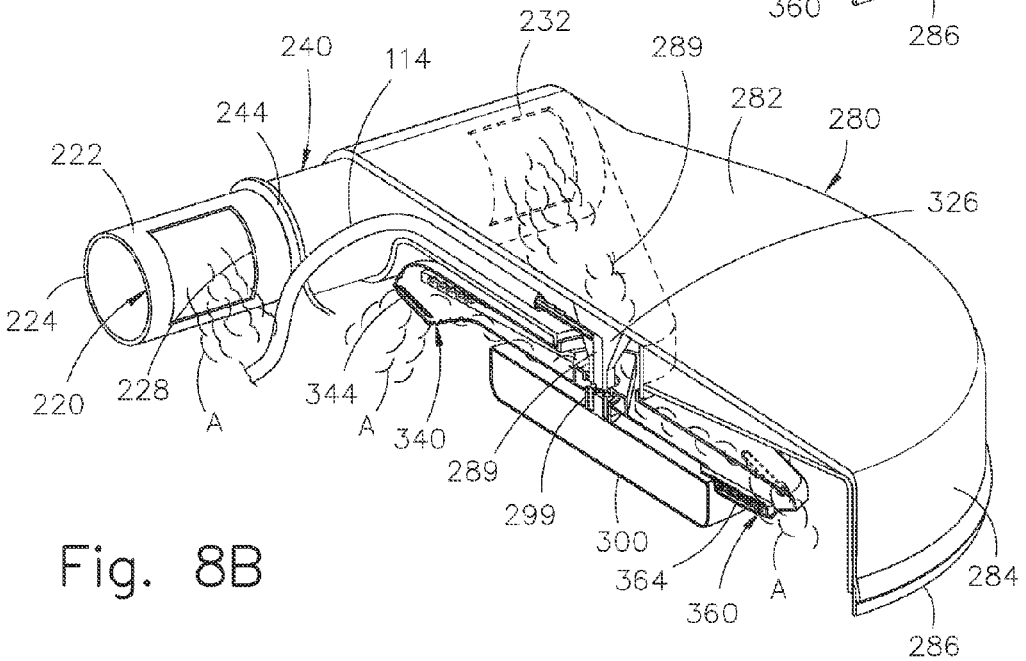
FIG. 8B is a partially sectioned isometric view of the cover assembly in the closed position and showing an activated air duct assembly.

As seen in FIGS. 8A and 8B, cover assembly 280 has been partially cross-sectioned to show how interior parts work. It is noted that when cover assembly 280 is closed, cutouts 228 and channel 289 are aligned thus permitting air A flowing from turbine assemblies 100 and 200 to flow through air duct assembly 340. Also, it is noted that side wall 284 positions around an external edge of toilet seat assembly 270 and alignment assembly 300 cooperatively fits onto inner edge 274, resting upon toilet seat assembly 270 in a way that a there is a clearance between alignment assembly 300 and inner edge 274 at front and sides. However, a rear portion of alignment assembly 300 snugly fits to a front section of manifold 240, thus preventing manifold flaps 248 from opening when cover assembly 280 is closed.

Figure 9A:
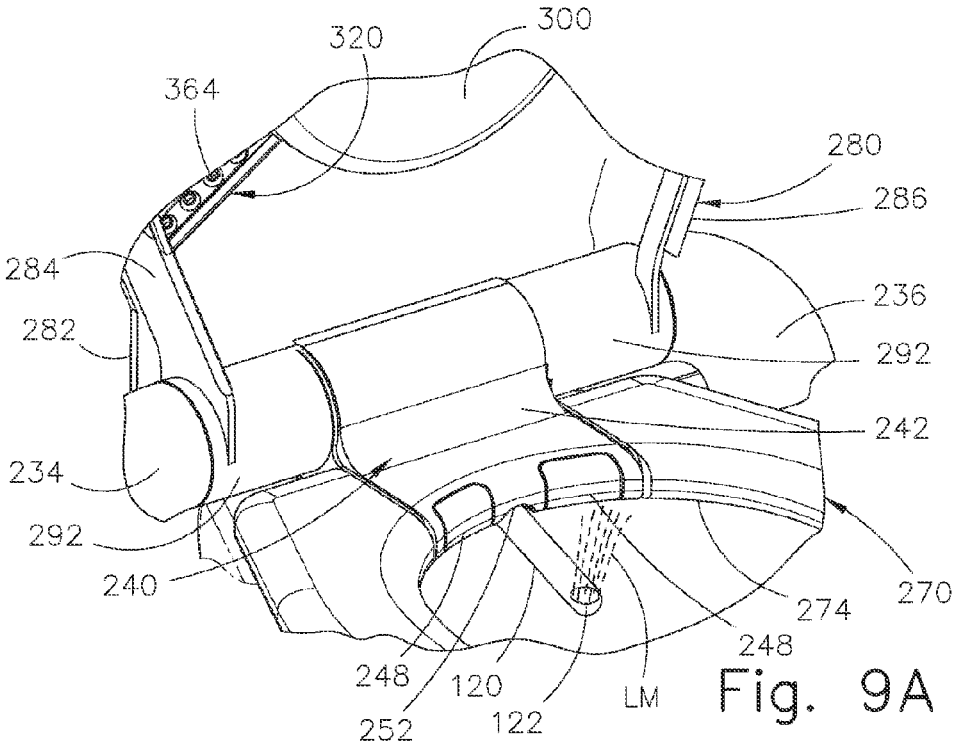
FIG. 9A is a partially sectioned isometric view of the instant invention, showing a bidet extended and in use.
Figure 9B:
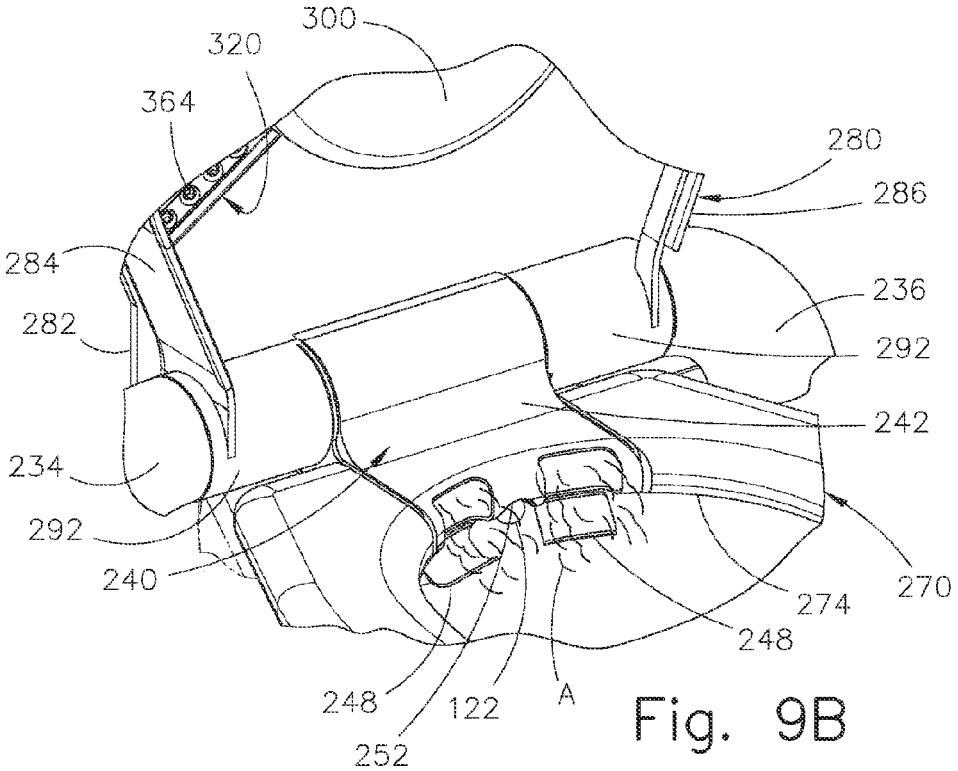
FIG. 9B is a partially sectioned isometric view of the instant 25 invention, showing the bidet retracted and manifold flaps In an open position, whereby forced air expels therefrom.
Figure 10:
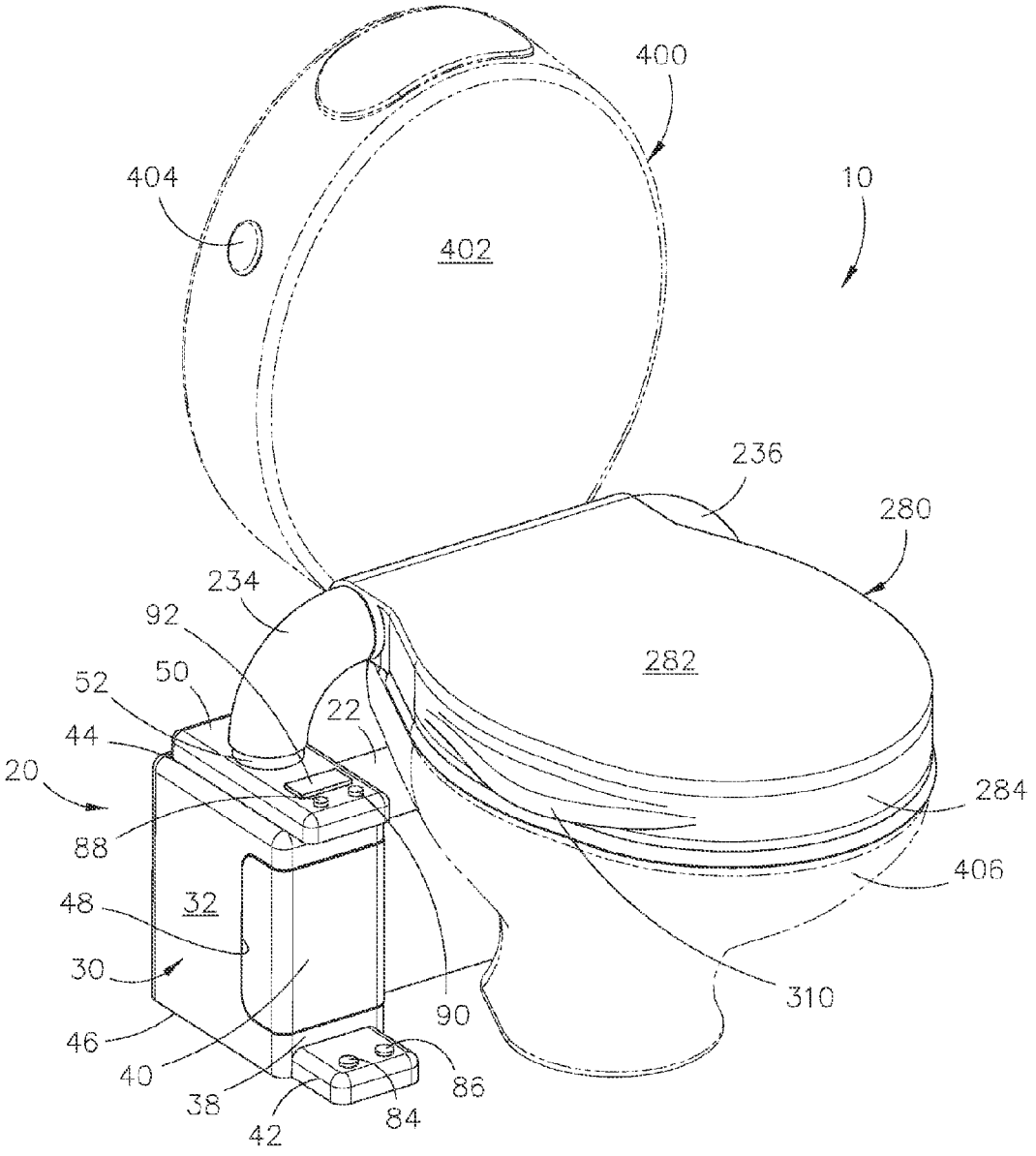
FIG. 10 is an isometric view of an alternate embodiment for the instant invention with its cover assembly in the closed position and installed onto an oval-shape toilet bowl.
Figure 11:
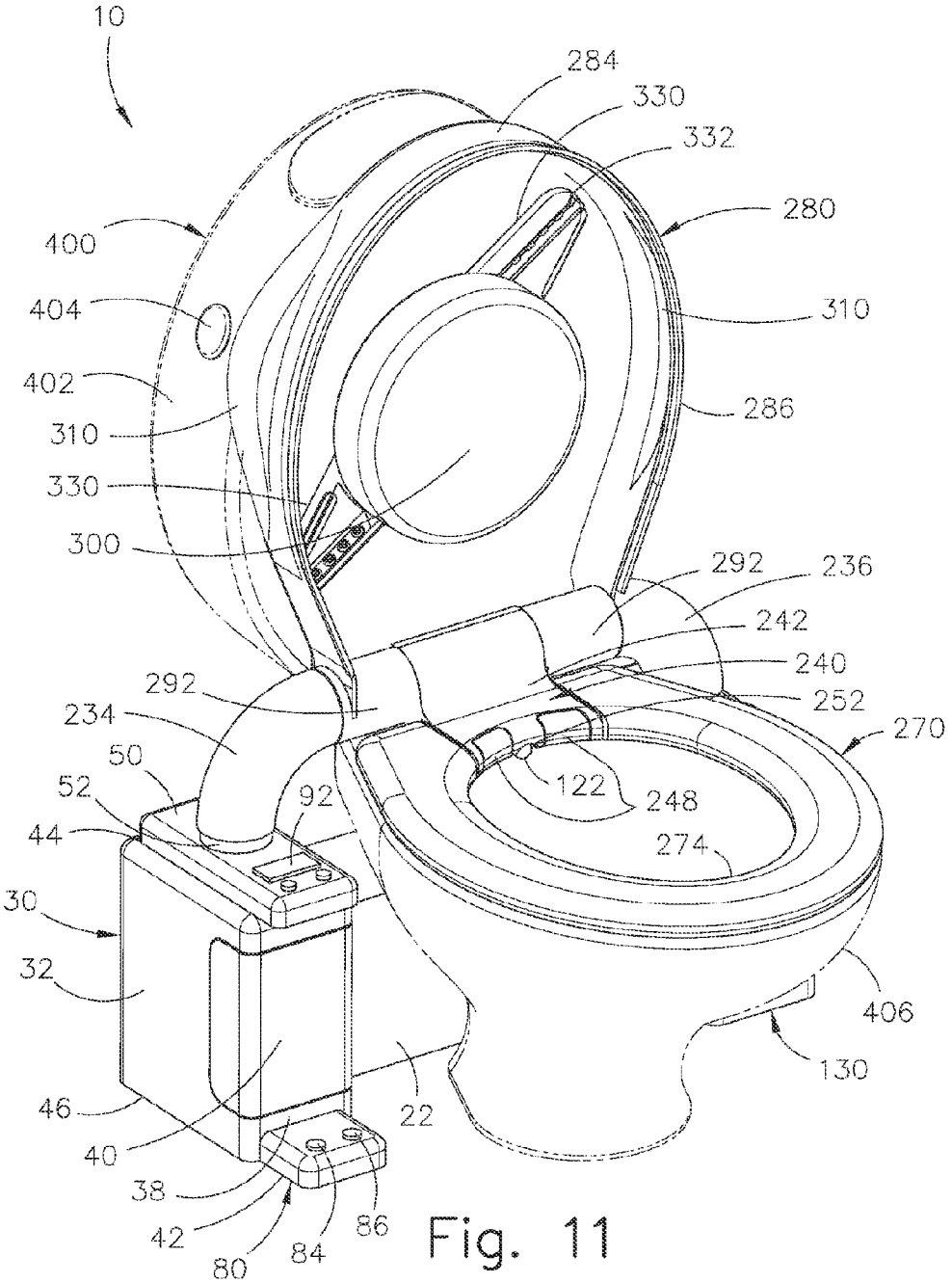
FIG. 11 is an isometric view of the alternate embodiment for the instant invention seen in FIG. 10, with its cover assembly in the open position and installed onto the standard toilet having the oval shape toilet bowl.

In operation, liquid matter duct assembly 360 is activated with switch 84 or 88, whereby liquid matter LM is delivered through cutouts 364 for a predetermined period of time on to toilet seat assembly 270. The disposition of sidewall 284 and alignment assembly 300 forces the delivered liquid matter LM to be directed inside toilet bowl 406. Once the cycle above has finished a displacing and drying cycle starts. Air A flowing from turbine assemblies 100 and 200 is directed through air ducts 234 and 236, cutouts 228 and 232, and then channel 289 into air duct assembly 340, exiting through cutouts 344 to displace and/or dry the liquid matter LM from the surface of toilet seat assembly 270. Instant invention 10 is then clean, sanitized, and ready for use by a user As seen in FIGS. 9A and 9B, once a user uses toilet 400, especially upon voiding, switch 86 or 90 is pressed to activate an anal cleaning cycle. Impeller pump 98 causes liquid matter LM to be expelled through bidet 122 for a predetermined period of time. The user can regulate the pressure of the liquid matter LM exiting bidet 122 by actuating pressure regulator 142. Liquid matter LM pressure causes telescopic section 120 to extend from bidet base 118. When the anal cleaning cycle ends, telescopic section 120 retracts back in to bidet base 118 and the anal drying cycle starts. Since cover assembly 280 is in an open position, channel 289 is covered by wall 222 of manifold assembly 220. Therefore, air A flowing from turbine assemblies 100 and 200 forces manifold flaps 248 to open. Air A flowing through manifold flaps 248 is directed to the user's anal area for a predetermined period of time. As seen in FIGS. 10 and 11, cover assembly 280 may comprise elongated protrusions 310 as an alternate embodiment. Elongated protrusions 310 are best utilized when toilet bowl 406 has a more oval shape as compared to a more circular shape as illustrated in FIG. 4. In operation, elongated protrusions 310 receive ends 332 of arms 330 as rotating arm assembly rotates therein.

Seen in FIG. 12 is a schematic diagram of the connections for instant invention 10. Water enters from a water source through line 116, having a one-way valve, flows to impeller pump 98. Liquid matter LM flow is selectively directed by electrical valves 96; either to liquid matter duct assembly 360, along with a predetermined amount of disinfectant from disinfectant container 112, or to bidet 122 with a pressure that user determines using pressure regulator 142.

Electrical wiring supplies electrical power to control box 82, which in turn is connected to turbine assemblies 100 and 200, impeller pump 98, and electrical valves 96. Retention valves can be conveniently disposed to control the direction of the water flow.

FIGS. 13A, 13B, 13C, 13D and 13E represent timing charts showing preferred dispositions and states of the components of instant invention 10 in a period of time as follows:

1. Period of time AB: Seat disinfectant cycle:

FIG. 13A: Cover assembly 280 is in a closed position.

FIG. 13B: Liquid matter LM is delivered through cutouts 364 of liquid matter duct assembly 360 and onto toilet seat assembly 270.

FIG. 13C: Air A from turbine assemblies 100 and 200 to air duct assembly 340 is OFF.

FIG. 13D: Water flow from impeller pump 98 to bidet 122 s OFF.

FIG. 13E: Air A flow from turbine assemblies 100 and 200 to manifold flaps 248 is OFF.

2. Period of time BC: Seat drying cycle starts:

FIG. 13A: Cover assembly 280 is in a closed position.

FIG. 13B: Liquid matter duct assembly 360 is OFF.

FIG. 13C: Air A from turbine assemblies 100 and 200 to air duct assembly 340 is ON. Air A flowing from turbine assemblies 100 and 200 is directed through air ducts 234 and 236, cutouts 228 and 232, channel 289 into air duct assembly 340, exiting through cutouts 344 to displace and/or dry the liquid matter LM from toilet seat assembly 270.

FIG. 13D: Water from impeller pump 98 to bidet 122 is OFF.

FIG. 13E: Air A flowing from turbine assemblies 100 and 200 to manifold flaps 248 is OFF.

3. Period of time CD: Anal cleaning cycle:

FIG. 13A: Cover assembly 280 is in an open position.

FIG. 13B: Liquid matter duct assembly 360 is OFF.

FIG. 13C: Air A flow from turbine assemblies 100 and 200 to air duct assembly 340 is OFF.

FIG. 13D: Water flow from impeller pump 98 to bidet 122 is ON. Water flowing from impeller pump 98 is expelled through bidet 122. Liquid matter LM pressure makes telescopic section 120 protrudes from bidet base 118.

FIG. 13E: Air A flow from turbine assemblies 100 and 200 to manifold flaps 248 is OFF.

4. Period of time DE: Anal area drying cycle:

FIG. 13A: Cover assembly 280 is in an open position.

FIG. 13B: Liquid matter duct assembly 360 is OFF.

FIG. 13C: Air A from turbine assemblies 100 and 200 to air duct assembly 340 is OFF.

FIG. 13D: Water flow from impeller pump 98 to bidet 122 is OFF.

FIG. 13E: Air A flow from turbine assemblies 100 and 200 to manifold flaps 248 is ON. Air A flowing from turbine assemblies 100 and 200 forces manifold flaps 248 to open. Air A flowing out through manifold flaps 248 is directed to the user's anal area.

FIGS. 14A, 14B, 14C, 14D and 14E represent timing charts showing alternate dispositions and states of the components of instant invention 10 in a period of time as follows:

1. Period of time AB: Seat disinfectant cycle:

FIG. 14A: Cover assembly 280 is in a closed position.

FIG. 14B: Liquid matter LM is delivered through cutouts 364 of liquid matter duct assembly 360 and onto toilet seat assembly 270.

FIG. 14C: Air A from turbine assemblies 100 and 200 to air duct assembly 340 is ON. Air A flowing from turbine assemblies 100 and 200 is directed through air ducts 234 and 236, cutouts 228 and 232, channel 289 into air duct assembly 340, exiting through cutouts 344 to displace and/or dry the liquid matter LM from toilet seat assembly 270.

FIG. 14D: Water flow from impeller pump 98 to bidet 122 is OFF.

FIG. 14E: Air A flow from turbine assemblies 100 and 200 to manifold flaps 248 is OFF.

2. Period of time BC: Seat drying cycle starts:

FIG. 14A: Cover assembly 280 is in a closed position.

FIG. 14B: Liquid matter duct assembly 360 is OFF.

FIG. 14C: Air A from turbine assemblies 100 and 200 to air duct assembly 340 is ON. Air A flowing from turbine assemblies 100 and 200 is directed through air ducts 234 and 236, cutouts 228 and 232, channel 289 into air duct assembly 340, exiting through cutouts 344 to displace and/or dry the liquid matter LM from toilet seat assembly 270.

FIG. 14D: Water from impeller pump 98 to bidet 122 is OFF.

FIG. 14E: Air A flowing from turbine assemblies 100 and 200 to manifold flaps 248 is OFF.

3. Period of time CD: Anal cleaning cycle: FIG. 14A: Cover assembly 280 is in an open position.

FIG. 14B: Liquid matter duct assembly 360 is OFF.

FIG. 14C: Air A flow from turbine assemblies 100 and 200 to air duct assembly 340 is OFF.

FIG. 14D: Water flow from impeller pump 98 to bidet 122 is ON. Water flowing from impeller pump 98 is expelled through bidet 122. Liquid matter LM pressure makes telescopic section 120 protrudes from bidet base 118.

FIG. 14E: Air A flow from turbine assemblies 100 and 200 to manifold flaps 248 is OFF.

4. Period of time DE: Anal area drying cycle:

FIG. 14A: Cover assembly 280 is in an open position.

FIG. 14B: Liquid matter duct assembly 360 is OFF.

FIG. 14C: Air A from turbine assemblies 100 and 200 to air duct assembly 340 is OFF.

FIG. 14D: Water flow from impeller pump 98 to bidet 122 is OFF.

FIG. 14E: Air A flow from turbine assemblies 100 and 200 to manifold flaps 248 is ON. Air A flowing from turbine assemblies 100 and 200 forces manifold flaps 248 to open. Air A flowing out through manifold flaps 248 is directed to the user's anal area.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A toilet seat cover assembly comprising:

a cover shaped to fit over a toilet seat, the cover including internal side walls; and an arm assembly disposed within the cover, the arm assembly including at least one arm:

radially spanning from an axis of rotation;

defining a path of rotation with a portion of the at least one arm operably configured to be in an overlapping configuration with a top surface of the toilet seat when the cover is in a closed position;

having a proximal end and a distal end, the distal end defining a discontinuity between the distal end and the internal side walls such that it is operable to move freely of the internal side walls; and defining a first plurality of cutouts:

disposed in an overlapping configuration with the top surface of the toilet seat when the cover is in the closed position; and fluidly coupled to a liquid source and sized to discharge liquid matter in a downward direction onto the toilet seat.

2. The toilet seat cover assembly of claim 1, wherein the arm assembly comprises:

two arms extending in substantially opposite directions from the axis of rotation.

3. The toilet seat cover assembly of claim 1, further comprising:

a manifold assembly partially disposed within the cover assembly, the manifold assembly operable to allow air to enter into the cover assembly from a turbine assembly.

4. The toilet seat cover assembly of claim 1, further comprising:

an alignment assembly disposed within the cover assembly, the alignment assembly operable to guide the liquid matter to a toilet bowl.

5. The toilet seat cover assembly of claim 1, wherein:

the liquid source and the first plurality of cutouts are fluidly coupled without fluid introduction from a tank of the toilet.

6. The toilet seat cover assembly of claim 1, further comprising:

an arm length defined by the proximal end and distal end of the at least one arm, the arm length of a fixed value during the path of rotation.

7. The toilet seat cover assembly of claim 1, wherein the at least one arm further comprises:

a second plurality of cutouts fluidly coupled to an air source and sized to discharge air over the toilet seat.

8. A toilet seat cover assembly comprising:

a cover shaped to fit over a toilet seat in a sealing relationship;

and an arm assembly disposed within the cover, the arm assembly:

freely rotatable around an axis of rotation defining a 360 degree path of rotation; and defining at least one cutout fluidly coupled to at least one of a liquid source and an air source, the at least one cutout and a portion of the arm assembly operably configured to be in an overlapping configuration with a top surface of the toilet seat when the cover is in a closed position over the toilet seat.

9. The toilet seat cover assembly of claim 8, wherein the arm assembly further comprises:

two arms extending in substantially opposite directions from the axis of rotation.

10. The toilet seat cover assembly of claim 8, further comprising:

a manifold assembly partially disposed within the cover assembly, the manifold assembly operable to allow air to enter into the cover assembly from a turbine assembly.

11. The toilet seat cover assembly of claim 8, further comprising:

an alignment assembly disposed within the cover assembly, the alignment assembly operable to guide the liquid matter to a toilet bowl.

12. The toilet seat cover assembly of claim 8, wherein:

the liquid source and the first plurality of cutouts are fluidly coupled without fluid introduction from a tank of the toilet.

13. The toilet seat cover assembly of claim 8, further comprising:

an arm length defined by the proximal end and distal end of the at least one arm, the arm length of a fixed value during the path of rotation.

14. A method of sanitizing a toilet seat comprising the steps of:

providing a cover assembly having:

a cover shaped to fit over a toilet seat in a sealing relationship, the cover including internal side walls; and an arm assembly disposed within the cover, the arm assembly including at least one arm:

radially spanning from, and freely rotatable around, an axis of rotation defining a 360 degree path of rotation, with a portion of the at least one arm operably configured to be in an overlapping configuration with a top surface of the toilet seat when the cover is in a closed position;

having a proximal end and a distal end, the distal end defining a discontinuity between the distal end and the internal side walls such that it is operable to move freely of the internal side walls; and defining at least one cutout fluidly coupled to at least one of a liquid matter source and an air source, the at least one cutout sized and shaped to direct the at least one of the liquid matter source and the air source in a downward direction onto the top surface of the toilet seat when the cover is in the closed position, thereby producing a downstream effect from the top surface of the toilet seat into a toilet bowl positioned below the top surface of the toilet seat.

15. The method of claim 14, further comprising:

providing a plurality of arms radially spanning from, and freely rotatable around, the axis of rotation.

16. The method of claim 14, further comprising:

providing a manifold assembly partially disposed within the cover assembly, the manifold assembly operable to allow air to enter into the cover assembly from a turbine assembly.

17. The method of claim 14, further comprising:

providing an alignment assembly disposed within the cover assembly, the alignment assembly operable to guide the liquid matter to the toilet bowl.

18. The method of claim 14, wherein:

the liquid source and the first plurality of cutouts are fluidly coupled without fluid introduction from a tank of the toilet.

19. The method of claim 14, further comprising:

an arm length defined by the proximal end and distal end of the at least one arm, the arm length of a fixed value during the 360 degree path of rotation.

* * * * *